US005116098A

United States Patent [19]

Wooten

[11] Patent Number: 5,116,098

[45] Date of Patent: May 26, 1992

[54] MULTIPLE DESK AND SEAT APPARATUS

[76] Inventor: Ginger M. Wooten, 112 Minosa Cir., Jacksonville, N.C. 28540

[21] Appl. No.: 529,538

[22] Filed: May 29, 1990

[51] Int. Cl.[5] ..... A47B 83/00

[52] U.S. Cl. ..... 297/170; 297/240; 297/135

[58] Field of Search ..... 297/135, 172, 174, 240, 297/241, 242; 108/50, 103, 104

[56] References Cited

U.S. PATENT DOCUMENTS

| | | | |
|---|---|---|---|
| 1,270,212 | 6/1918 | Richeson | 297/135 |
| 3,647,287 | 3/1972 | Schwind | 108/103 |
| 3,913,901 | 10/1975 | Molders | 248/631 |
| 4,117,627 | 10/1978 | Slingerland, Jr. | 108/103 |
| 4,237,796 | 12/1980 | Gordon et al. | 108/103 |
| 4,626,018 | 12/1986 | Mossey | 248/631 |
| 4,720,068 | 1/1988 | Tornero | 248/161 |

*Primary Examiner*—Kenneth J. Dorner
*Assistant Examiner*—Cassandra Hope
*Attorney, Agent, or Firm*—Leon Gilden

[57] ABSTRACT

An apparatus including a central seat rotatably mounted to selectively confront one of an annular array of desks positioned about the seat. The desks are mounted to an upper ring, wherein a lower ring concentrically positioned below the upper ring provides a foot rest for an individual positioned within the seat. The seat is mounted upon a dampener member to accommodate bouncing of an individual upon the seat structure. The desks are removably mounted relative to the upper ring to accommodate various positions and desks for securement to the upper ring.

6 Claims, 6 Drawing Sheets

PRIOR ART

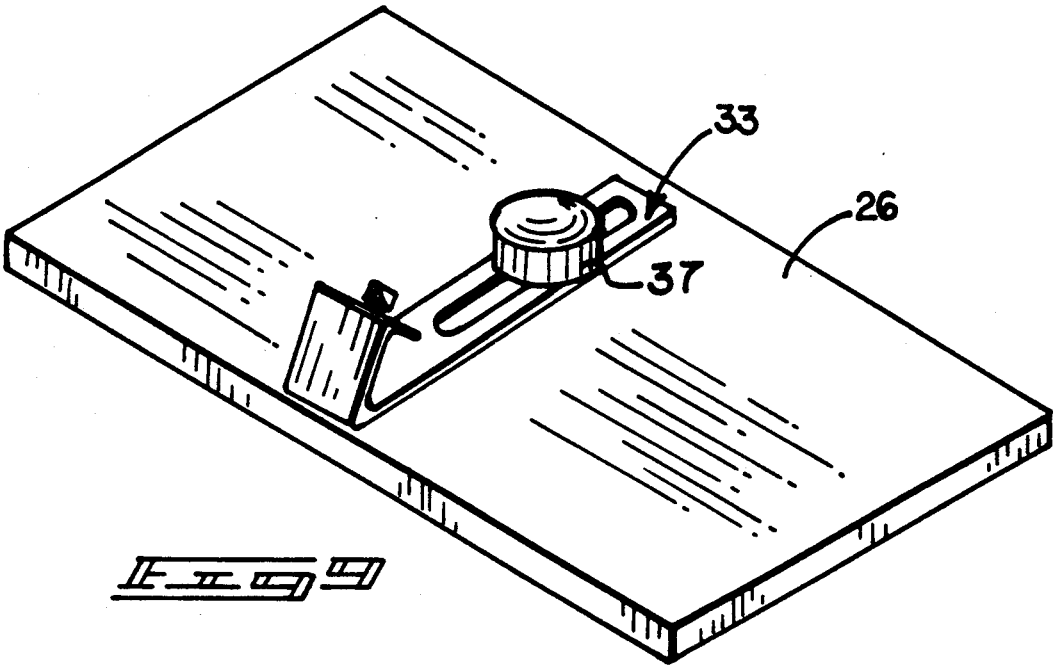
Fig 9
Fig 10
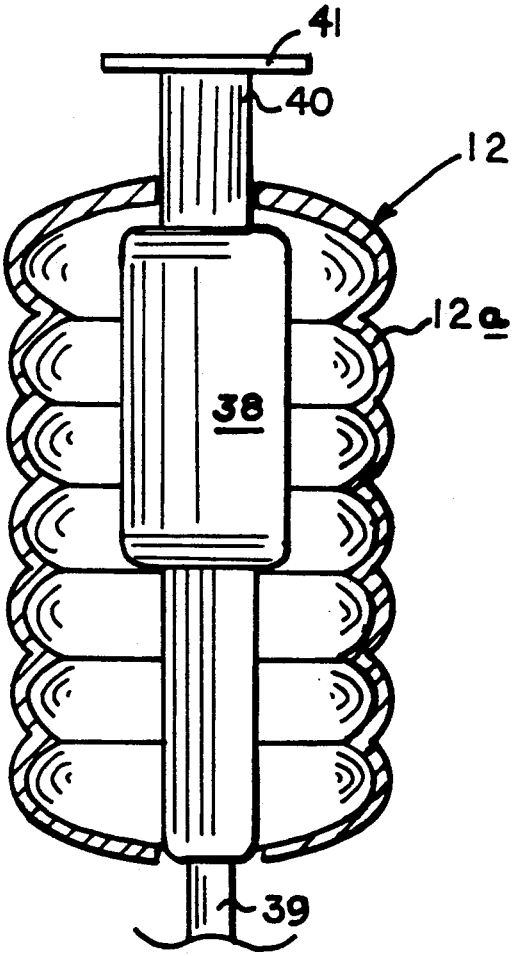

MULTIPLE DESK AND SEAT APPARATUS

BACKGROUND OF THE INVENTION

1. Field of the Invention

The field of invention relates to seat and desk structure, and more particularly pertains to a new and improved multiple desk and seat apparatus wherein the same permits selective orientation of an individual relative to a selective desk, wherein the desks are annularly positioned about a central coaxially positioned seat.

2. Description of the Prior Art

Seating arrangements of various types have been utilized throughout the prior art to accommodate various requirements of individuals. The instant invention sets forth an organization to provide a convenient orientation of an individual relative to a multiple of replaceable desks to accommodate various needs, and particularly to accommodate children and the like, and to keep such children amused by providing a variety of entertainment and refreshment positions relative to a child. Examples of prior art seating arrangements may be found in U.S. Pat. No. 3,109,678 to Wilson wherein a multiple of seats are positioned relative to a central table, and wherein the organization is interfolded for convenience of storage.

U.S. Pat. No. 4,216,993 to Schumaker sets forth a central table, including a series of seats positioned thereabout.

U.S. Pat. No. 4,607,880 to Gastebled provides a knock-down picnic table utilizing spaced parallel seats and a medially oriented table.

U.S. Pat. No. 1,797,717 to Coates sets forth a work bench providing a central table for accommodating a variety of operations thereon.

As such, it may be appreciated that there continues to be a need for a new and improved multiple desk and seat apparatus wherein the same provides a multiple of accessible peripheral tables positioned exteriorly of a medially positioned seat for entertainment and accommodation of a variety of activities of an individual mounted within the seat.

SUMMARY OF THE INVENTION

In view of the foregoing disadvantages inherent in the known types of desk and seat apparatus now present in the prior art, the present invention provides a multiple desk and seat apparatus wherein the same includes a medial positioned seat and a surroundingly oriented array of desks to accommodate a variety of activities by an individual. As such, the general purpose of the present invention, which will be described subsequently in greater detail, is to provide a new and improved multiple desk and seat apparatus which has all the advantages of the prior art desk and seat apparatus and none of the disadvantages.

To attain this, the present invention provides an apparatus including a central seat rotatably mounted to selectively confront one of an annular array of desks positioned about the seat. The desks are mounted to an upper ring, wherein a lower ring concentrically positioned below the upper ring provides a foot rest for an individual positioned within the seat. The seat is mounted upon a dampener member to accommodate bouncing of an individual upon the seat structure. The desks are removably mounted relative to the upper ring to accommodate various positions and desks for secruement to the upper ring.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multiple desk and seat apparatus which has all the advantages of the prior art desk and seat apparatus and none of the disadvantages.

It is another object of the present invention to provide a new and improved multiple desk and seat apparatus which may be easily and efficiently manufactured and marketed.

It is a further object of the present invention to provide a new and improved multiple desk and seat apparatus which is of a durable and reliable construction.

An even further object of the present invention is to provide a new and improved multiple desk and seat apparatus which is susceptible of a low cost of manufacture with regard to both materials and labor, and which accordingly is then susceptible of low prices of sale to the consuming public, thereby making such multiple desk and seat apparatus economically available to the buying public.

Still yet another object of the present invention is to provide a new and improved multiple desk and seat apparatus which provides in the apparatuses and methods of the prior art some of the advantages thereof, while simultaneously overcoming some of the disadvantages normally associated therewith.

Still another object of the present invention is to provide a new and improved multiple desk and seat apparatus wherein the same accommodates a variety of activities surroundingly positioned about a central seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an isometric illustration of the desk clamp mounted to an associated desk for securement to the top rail of the instant invention.

FIG. 10 is an orthographic view, taken along the lines 10—10 of FIG. 4, in the direction indication by the arrows.

DESCRIPTION OF THE PREFERRED EMBODIMENT

Figure 1:
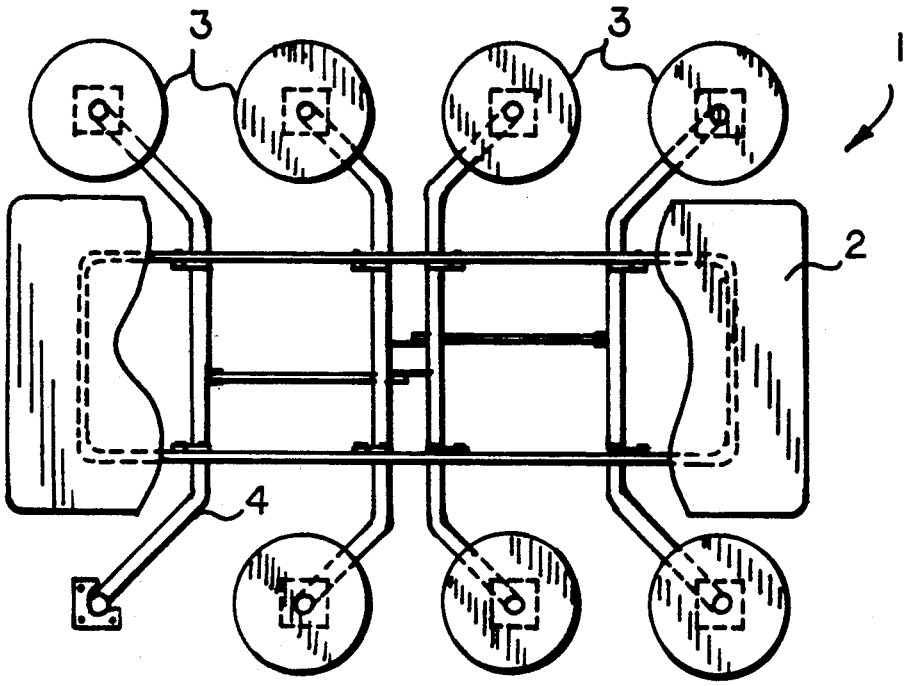
FIG. 1 is a top orthographic view, partially in section, of a prior art desk and seat apparatus.

With reference now to the drawings, and in particular to FIGS. 1 to 12 thereof, a new and improved multiple desk and seat apparatus embodying the principles and concepts of the present invention and generally designated by the reference numeral 10 will be described.

Figure 2:
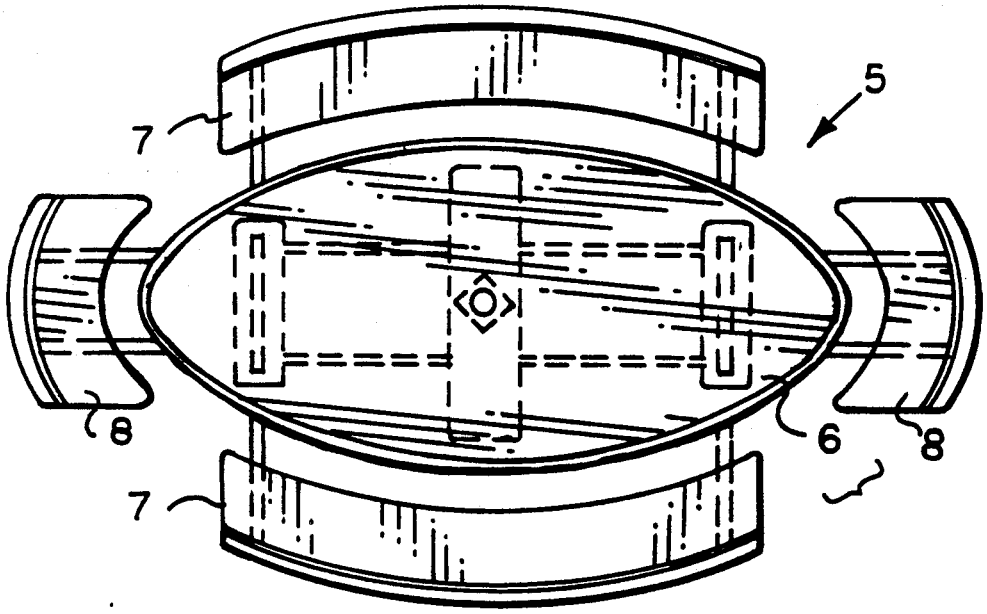
PRIOR ART FIG 2
FIG. 2 is a top orthographic view of a further prior art desk and seat apparatus.

FIG. 1 illustrates a prior art seat and table organization 1, wherein a central table member 2 includes a plural series of seats 3 positioned on either side longitudinally of the table mounted on a central framework 4 that is interfolded for storage during periods of non-use. FIG. 2 illustrates a further prior art organization 5, with a central table 6 and a plurality of side seats 7 and end seats 8 in association with the central table 6.

More specifically, the multiple desk and seat apparatus 10 of the instant invention essentially comprises a support base housing 11 mounting a pedestal 12 orthogonally and medially of the housing 11. The pedestal 12 includes a spring bellows housing 12*a* in surrounding relationship relative to a central support rod, including a lower support rod 39 mounted to an upper support rod 40, with a gas-filled dampener 38 positioned intermediate and coaxially of the lower and upper support rods 39 and 40 respectively (see FIG. 10). The pedestal 12 mounts an "L," shaped seat 13 thereon fixedly mounted to a seat support plate 41 that in turn is fixedly mounted to the upper support rod 40. The dampener 38, as well as the spring bellows housing 12*a*, accommodates impact and bouncing by an individual upon the seat structure 13.

Figure 3:
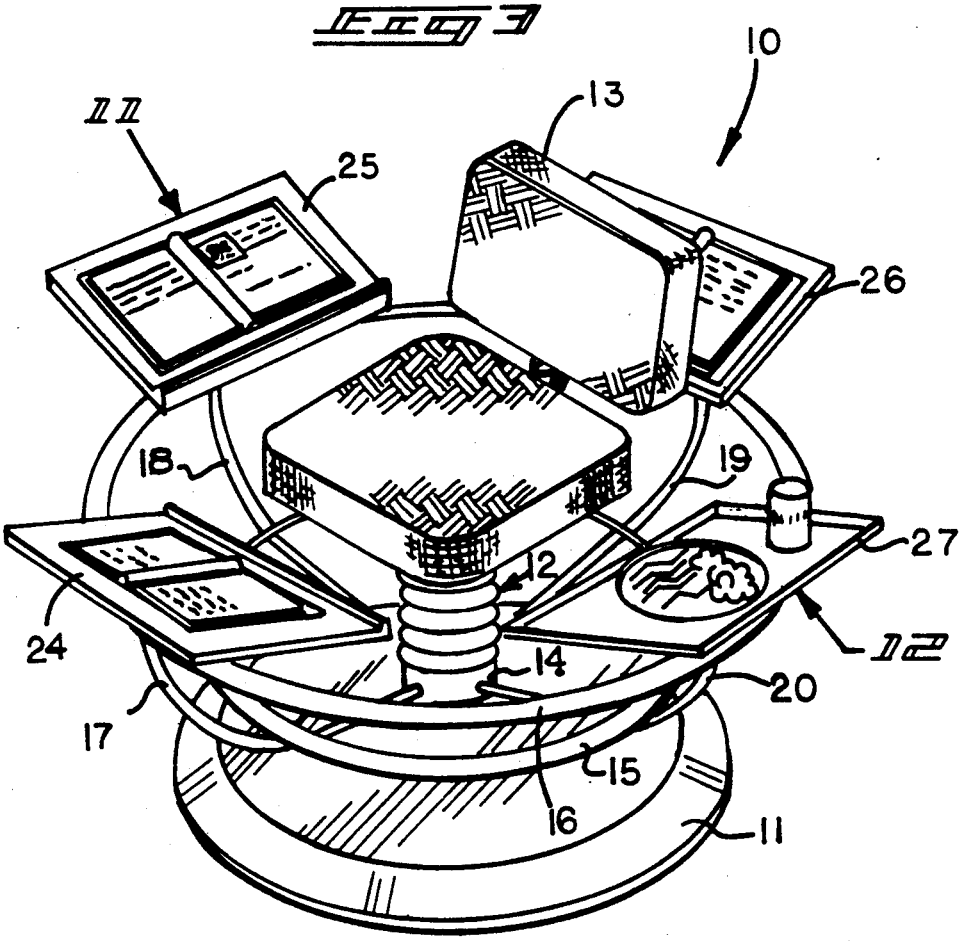
FIG. 3 is an isometric illustration of the instant invention.
Figure 4:
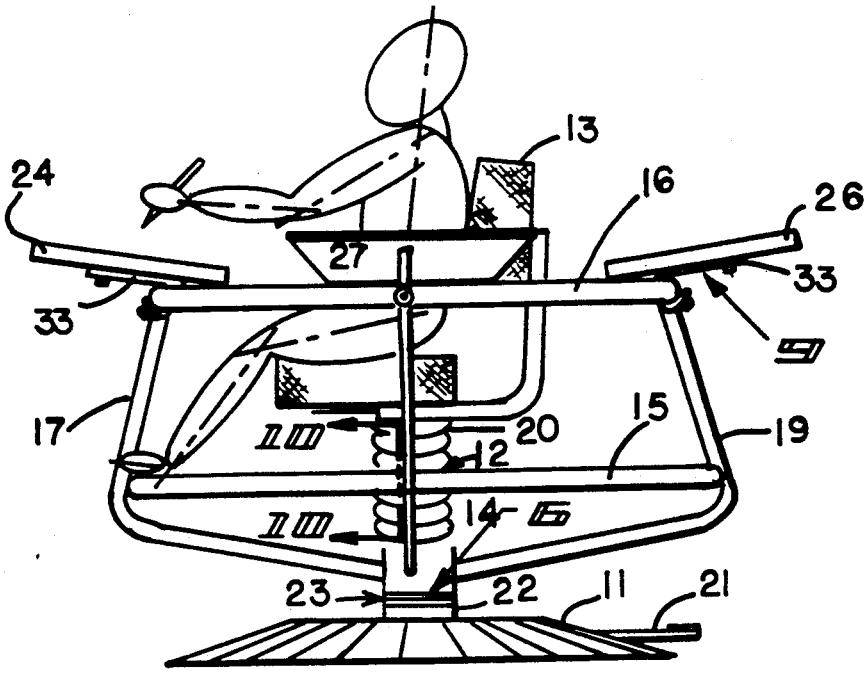
FIG. 4 is an orthographic side view, taken in elevation, of the instant invention.
Figure 5:
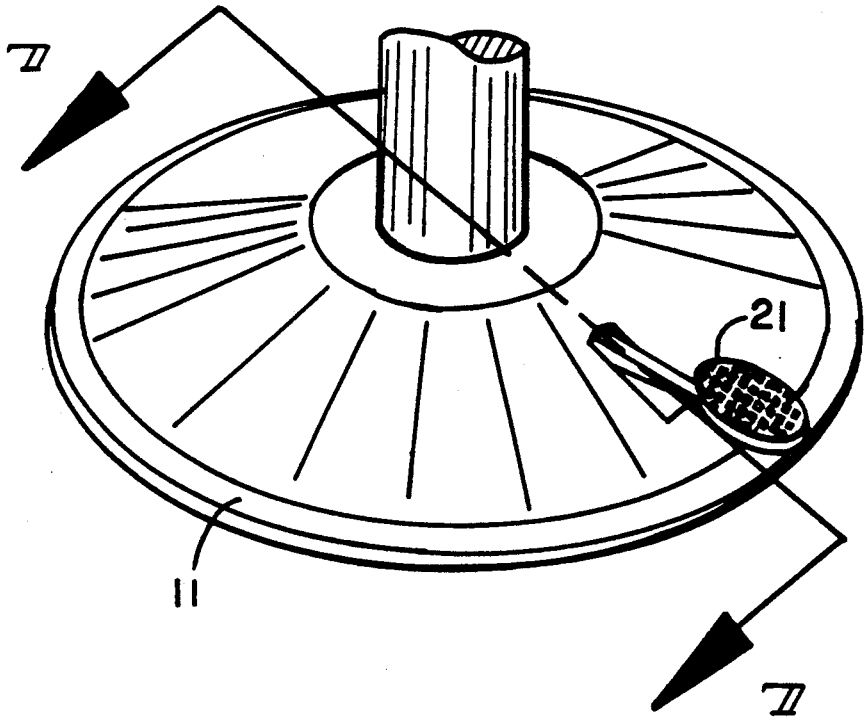
FIG. 5 is an isometric sectional illustration of the pedestal portion of the instant invention.
Figure 6:
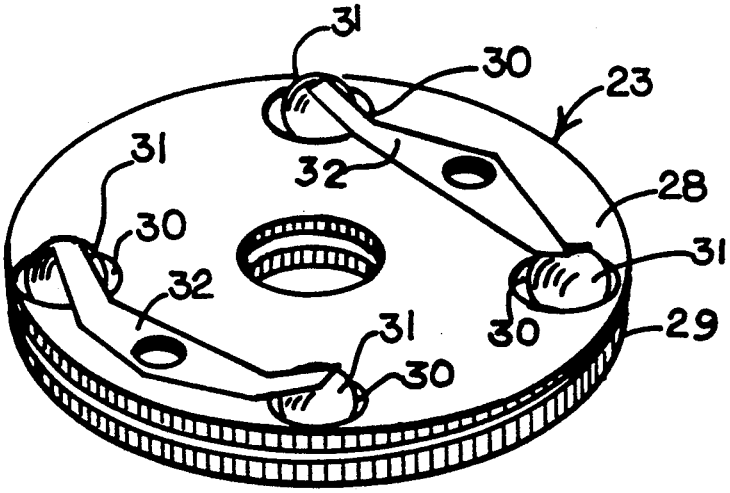
FIG. 6 is an isometric illustration of the section 6 as set forth in FIG. 4.
Figure 7:
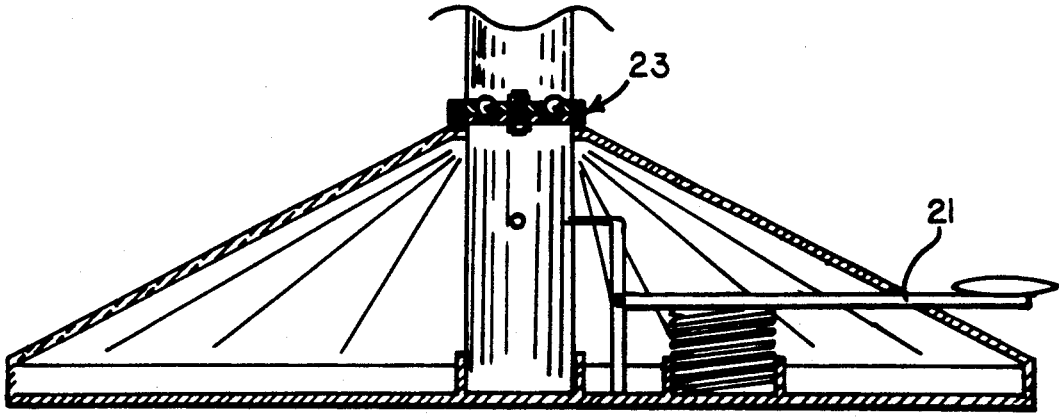
FIG. 7 is an orthographic view, taken along the lines 7—7 of FIG. 5, in the direction indicated by the arrows.
Figure 8:
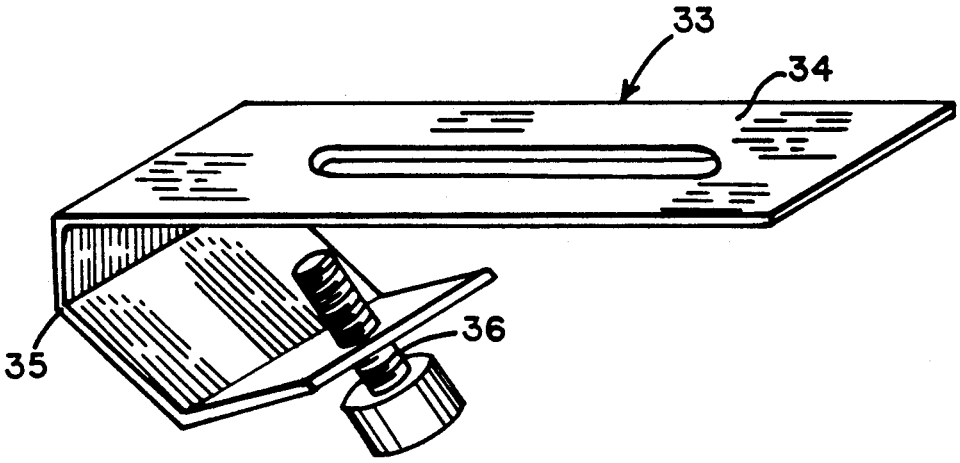
FIG. 8 is an isometric illustration of a desk clamp utilized by the instant invention.

A first support ring 15 is spaced coaxially of the pedestal 12 and underlying a second support ring 16 (see FIG. 4). The first support ring 15 provides a support for an individual's foot rest mounted within the seat, while the second support ring 16 selectively mounts a series of desks thereon. Securing and positioning the first and second rings relative to the pedestal 12 are a first, second, third, and fourth arcuate rib 17, 18, 19, and 20 respectively. The arcuate ribs are positioned at ninety degrees relative to one another to define an encircling relationship relative to the upper support base 14 that supports the pedestal 12 thereon. The upper support base 14 is rotatably mounted upon a lower base 22 by use of an intermediate swivel plate 23. The swivel plate (see FIG. 6) includes an upper plate 28 rotatably mounted and coaxially positioned coextensively with a lower plate 29. Spaced pairs of apertures 30 mount spherical bearings 31 thereon positioned and secured within the apertures 30 by bearing plates 32 that secure and position the spherical bearings 31 within their respective apertures 30. The upper support base 14 is fixedly mounted to the upper plate, with the lower support base fixedly mounted to the support base housing 11 to permit relative rotation of the first and second support rings 15 and 16 relative to the "L" shaped seat, as the "L" shaped seat 13 is fixedly mounted, via shaft 39 and support base 14 relative, the central opening of the upper plate 28 and secured to the lower plate 29 that defines an integral association with the lower base 22 to permit relative rotation of the second and first support rings 16 and 15 and the associated desks mounted thereon. The desks include a first, second, and third desk 24, 25, and 26, with a fourth desk tray mounted thereon. The desks are typically positioned ninety degrees apart relative to one another and are selectively securable to the second ring 16 utilizing desk support brackets 33. A typical desk support bracket 33, as illustrated in FIG. 3, including a slotted top bracket plate 34 that is fixedly mounted to a bottom surface of each desk utilizing a second fastener 37 (see FIG. 9), with a cup-shaped lower bracket 35 underlying the support bracket 33 receiving the second support ring 16 therethrough and clamp in place by a first threaded fastener bolt 36.

Figure 11:
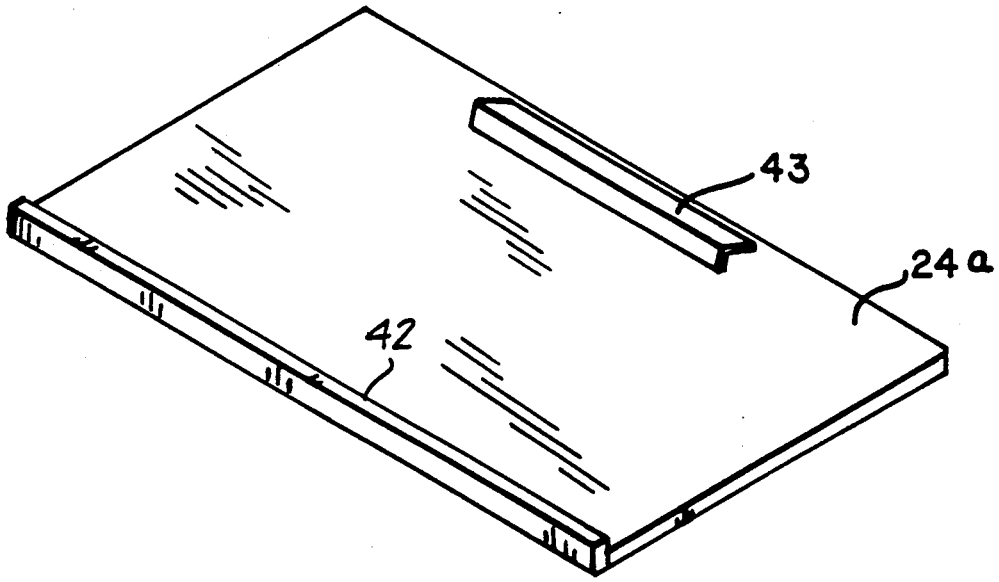
FIG. 11 is an isometric illustration of a desk structure utilized by the instant invention.
Figure 12:
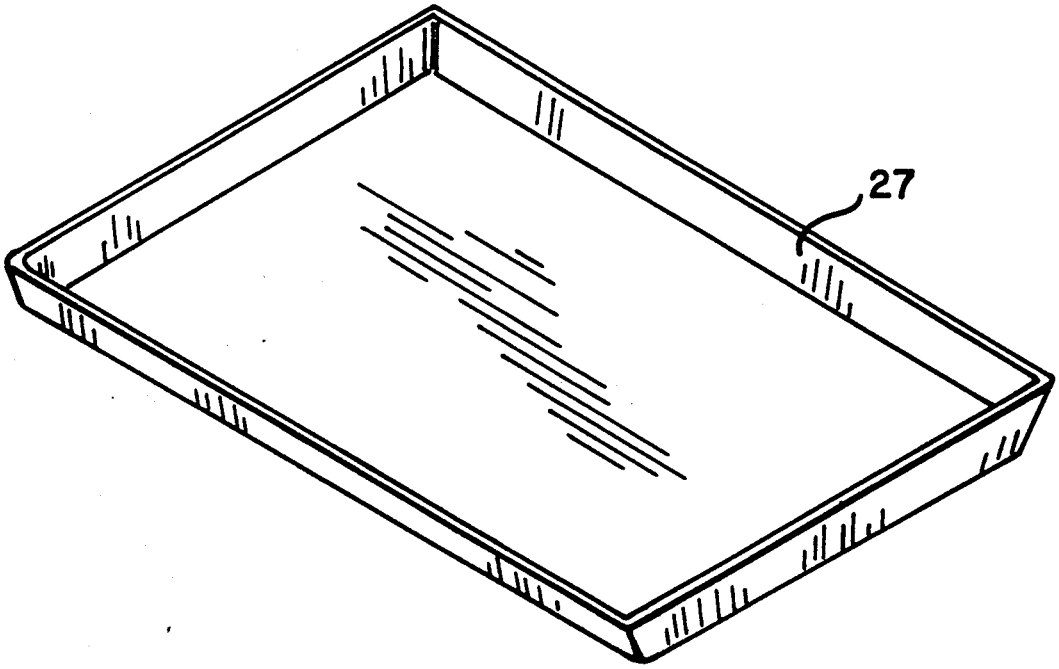
FIG. 12 is an isometric illustration of a tray structure utilized by the instant invention.

A typical desk, as illustrated in FIG. 11, provides a desk 24*a* including a support clip 43 at an upper end thereof to secure a book or the like therewithin, with an abutment lip 42 mounted fixedly to a lower edge of each desk to maintain articles mounted within the desk from falling therefrom.

Accordingly, an individual may sit within the seat 13 permitting rotation of the first and second rings 15 and 16 relative to that individual to position various selective ones of the desks 24–27 for operative association with that individual.

It should also be noted that the support base housing 11 includes a lift lever 21 that is arranged for vertical deflection to permit a vertical adjustment of the seat 13.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multiple desk and seat apparatus comprising, in combination,

An "L" shaped seat member, the "L" shaped seat member fixedly mounted to an upper support rod, the upper support rod spaced from and coaxially aligned with a lower support rod, the lower support rod and the upper support rod including a shock-absorbing dampener mounted therebetween, the lower rod and upper rod including a spring bellows housing mounted about the upper and lower rods and the shock-absorbing dampener, and the lower rod mounted to a lower support base, the lower support base mounted to a support base housing, and an upper support base coaxially aligned with and overlying the lower support base underlying the spring member with the upper support base rotatably mounted relative to the lower support base, wherein the upper support base includes a framework means positioned for rotation about the seat and the lower support base, the framework means mounted to the upper support base, and the framework means including a plurality of desks mounted thereon.

2. An apparatus as set forth in claim 1 wherein the framework means includes a first, second, third, and fourth arcuate rib, the arcuate ribs fixedly mounted to the upper support base mounted upwardly therefrom and arranged at ninety degrees relative to one another, and a first support ring and a second support ring coaxially aligned with the upper support base spaced above the upper support base, wherein the upper support ring is spaced above the lower support ring, the upper support ring selectively mounted to the desks thereon.

3. An apparatus as set forth in claim 2 wherein the desks include a first, second, third, and fourth desk, wherein the desks are selectively securable to the second support ring, and wherein each desk includes a desk, each desk support bracket includes a slotted top bracket plate mounted to the bottom surface of each desk utilizing a second fastener, with each desk support bracket including a cup-shaped lower bracket secured to each top bracket, wherein each cup-shaped lower bracket slidably receives the second ring therewithin, with a first threaded fastener bolt directed through the lower bracket to secure the second support ring therewithin.

4. An apparatus as set forth in claim 3 wherein the upper support base is rotatably mounted to the lower support base, including a swivel plate mounted therebetween, the swivel plate including an upper plate rotatably mounted to a lower plate, the lower plate mounted to the lower support base, with the upper plate mounted to the upper support base, and the upper plate including a plurality of apertures directed therethrough, wherein each aperture includes a spherical bearing mounted therewithin, including bearing plates secured to the bearings within each of the apertures to effect selective rotation of the upper plate relative to the lower plate.

5. An apparatus as set forth in claim 4 wherein the fourth desk comprises a tray.

6. An apparatus as set forth in claim 5 wherein one of said desks includes a support clip mounted adjacent an upper edge of said desk, with an abutment lip mounted at a lower edge of said desk directed upwardly therefrom to contain articles positioned on said desk.

* * * * *